US010856657B2

(12) United States Patent
Felsenthal et al.

(10) Patent No.: US 10,856,657 B2
(45) Date of Patent: Dec. 8, 2020

(54) OVER-THE-DOOR STORAGE ORGANIZER

(71) Applicant: Whitmor, Inc., Southaven, MS (US)

(72) Inventors: Sandy Felsenthal, Memphis, TN (US); Lauren Budzak, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 16/800,585

(22) Filed: Feb. 25, 2020

(65) Prior Publication Data

US 2020/0187645 A1 Jun. 18, 2020

Related U.S. Application Data

(63) Continuation-in-part of application No. 15/973,476, filed on May 7, 2018, now Pat. No. 10,568,421.

(51) Int. Cl.
*A47B 61/04* (2006.01)

(52) U.S. Cl.
CPC ..... *A47B 61/04* (2013.01)

(58) Field of Classification Search
CPC ..... A47B 61/04; A47B 43/00; A47B 43/003; A47B 95/00; A47F 7/146; A47F 7/08; A45C 7/0095; A45C 7/02; A45C 3/004; A45C 11/26; A47G 25/005
See application file for complete search history.

(56) References Cited

U.S. PATENT DOCUMENTS 405,955 A * 6/1889 Feineman ..... A47F 7/163 211/45
2,205,205 A * 6/1940 King ..... A45C 11/008 206/581
2,359,372 A * 10/1944 Leader ..... A45C 3/12 383/39
2,423,297 A * 7/1947 Creamer ..... A45C 7/0095 206/279
2,532,517 A * 12/1950 Schwartzman ..... A47G 25/005 383/39
2,780,260 A * 2/1957 Watson ..... A47G 25/005 383/23
2,832,389 A * 4/1958 Smith ..... A47G 25/005 383/9
3,029,852 A * 4/1962 Taylor ..... A45C 3/00 383/2
D197,146 S * 12/1963 Fisher ..... D6/315
(Continued)

*Primary Examiner* — Patrick D Hawn
(74) *Attorney, Agent, or Firm* — Stites & Harbison PLLC; Richard S. Myers, Jr.

(57) ABSTRACT

An organizer that is typically configured to hang from a door, the organizer including a base layer having a front surface and a back surface, and defining a shape of said organizer; at least one compartment provided on said base layer front surface; and a support component configured to provide structural support for said organizer, said support component including a first pocket provided on said base layer and extending at least part of a length of said base layer; a first support rod positioned within said first pocket; a second pocket provided on said base layer and extending at least part of said length of said base layer; and a second support rod positioned within said second pocket; wherein the first and second pockets join at a seam that permits the organizer to be folded along said seam in a lengthwise direction; and wherein the organizer also includes a detachable shelf unit.

16 Claims, 14 Drawing Sheets

(56) References Cited

U.S. PATENT DOCUMENTS 3,120,297 A * 2/1964 Riley ..... A45C 7/0095 190/110
3,181,751 A * 5/1965 Wilson ..... A01K 97/06 383/39
3,187,903 A * 6/1965 Oltz ..... A47F 7/146 211/88.01
3,207,421 A * 9/1965 Hunger ..... B42D 5/047 229/72
3,294,134 A * 12/1966 Matross ..... A47G 25/54 383/39
3,967,666 A * 7/1976 Farrar ..... A61G 7/0503 383/7
4,401,219 A * 8/1983 Mink ..... A45C 7/0095 206/466
4,585,127 A * 4/1986 Benedict ..... A47B 61/02 211/34
4,738,547 A * 4/1988 Brown ..... A45C 7/0095 383/119
4,901,899 A * 2/1990 Barrett ..... A01K 97/06 206/315.11
4,947,987 A * 8/1990 Keenan ..... A47G 25/14 206/278
4,949,843 A * 8/1990 Stokes ..... A45C 7/0095 206/305
4,958,727 A * 9/1990 Bergeron ..... A45C 9/00 206/489
4,960,204 A * 10/1990 Young ..... A45C 3/00 190/109
4,966,287 A * 10/1990 Snyder ..... A45C 11/16 211/113
5,002,401 A * 3/1991 Blackman ..... A45C 7/0095 150/112
5,025,918 A * 6/1991 Bergeron ..... A45C 9/00 206/495
5,065,864 A * 11/1991 Schmitt ..... A45C 3/00 190/110
5,121,833 A * 6/1992 Lindsay ..... A45C 7/0095 206/18
5,141,113 A * 8/1992 Elliott ..... A45C 11/16 206/495
5,209,344 A * 5/1993 Smith ..... A45C 7/0095 206/466
5,259,497 A * 11/1993 Brothers ..... A45D 8/185 206/6.1
5,333,727 A * 8/1994 Hoppe ..... A47F 7/02 206/486
5,350,071 A * 9/1994 Pond ..... A47B 43/003 211/117
5,427,230 A * 6/1995 Mattox ..... A45C 11/16 206/478
5,533,534 A * 7/1996 Cariello ..... A47K 3/281 132/286
5,692,604 A * 12/1997 Houk ..... A45C 3/004 190/111
5,779,033 A * 7/1998 Roegner ..... A45C 11/16 206/6.1
5,875,902 A * 3/1999 Emery ..... A47B 96/16 108/29
6,073,642 A * 6/2000 Huang ..... A45B 9/00 135/114
D429,886 S * 8/2000 Avent ..... D3/303
6,223,914 B1 * 5/2001 Snell ..... A47G 25/06 211/117
6,318,822 B1 * 11/2001 Wang ..... A47B 43/003 108/149
6,464,086 B1 * 10/2002 Klein ..... A47B 96/16 211/35
6,467,613 B2 * 10/2002 Felsenthal ..... A01M 1/2055 206/213
D487,635 S * 3/2004 Collins ..... D3/315
6,719,157 B2 * 4/2004 Stoddart ..... A47B 43/00 211/118
6,732,659 B2 * 5/2004 Poon ..... A47B 47/0075 108/42
6,874,624 B2 * 4/2005 Redzisz ..... A45C 11/00 190/126
7,028,870 B2 * 4/2006 Valdez-Campbell ..... A45C 7/0095 224/153
7,178,769 B2 * 2/2007 Magnusson ..... A47B 96/1416 211/119.004
D543,760 S * 6/2007 Utzinger, III ..... D6/553
7,264,127 B2 * 9/2007 Jones ..... A47J 47/16 206/320
7,681,728 B2 * 3/2010 Sabounjian ..... A45C 7/0077 206/278.1
D627,163 S * 11/2010 Kittrell ..... D3/283
7,866,493 B1 * 1/2011 Hurt ..... A47B 96/16 211/113
7,938,279 B2 * 5/2011 Kaplan ..... A47B 43/003 108/47
8,181,775 B2 * 5/2012 Bunn ..... A45C 13/03 206/315.1
8,627,950 B2 * 1/2014 Bland ..... A45C 7/0077 206/495
8,701,952 B1 * 4/2014 Tripp ..... B60R 11/06 224/543
8,800,789 B2 * 8/2014 Sharp ..... A47F 7/02 211/85.2
8,925,740 B1 * 1/2015 Fanok ..... A47G 25/005 211/119.004
9,072,362 B2 * 7/2015 Gallup ..... A45F 5/00
9,287,107 B2 * 3/2016 Powell ..... H01K 3/32
10,111,546 B1 * 10/2018 Springs ..... B25C 7/00
10,238,221 B2 * 3/2019 Kressin ..... A47G 1/02
10,398,223 B2 * 9/2019 Felsenthal ..... A47G 25/743
10,568,421 B2 * 2/2020 Felsenthal ..... A47G 29/00
2002/0190017 A1 * 12/2002 Stevens ..... A47B 43/006 211/118
2004/0016670 A1 * 1/2004 Lewand ..... A45C 11/16 206/459.5
2004/0251795 A1 * 12/2004 Wang ..... A47B 47/04 312/6
2005/0230336 A1 * 10/2005 Mundy ..... A47B 43/00 211/113
2006/0207956 A1 * 9/2006 Sivers ..... A47G 29/00 211/113
2007/0138222 A1 * 6/2007 Goldman ..... A45C 7/0095 224/401
2007/0163977 A1 * 7/2007 Wang ..... A47B 43/003 211/118
2007/0200470 A1 * 8/2007 Wang ..... A47B 43/003 312/6
2013/0048587 A1 * 2/2013 Gallup ..... A45F 5/00 211/132.1
2013/0256159 A1 * 10/2013 Walsh ..... A45C 11/16 206/6.1
2015/0289619 A1 * 10/2015 Cogan ..... A45C 3/004 190/109
2017/0251808 A1 * 9/2017 Ruiz ..... A47B 43/04
2018/0317647 A1 * 11/2018 Felsenthal ..... A47G 29/00
2019/0021521 A1 * 1/2019 Kula ..... A47B 57/404

* cited by examiner

OVER-THE-DOOR STORAGE ORGANIZER

CROSS-REFERENCE TO RELATED APPLICATIONS

This application claims priority to U.S. Pat. No. 10,568,421, filed May 7, 2018, which claims benefit to U.S. Patent Application No. 62/502,218, filed May 5, 2017; the contents of both are incorporated herein by reference.

BACKGROUND OF THE INVENTION

The present invention relates generally to hanging organizers, storage compartments, shoe racks and the like, and particularly, hanging organizers that are typically configured to be hung from a door or closet rod or mounted to a wall. The hanging organizers commonly known in the art include a rigid frame component provided near the top of the organizer to provide structural support for the organizer and allow the organizer to be hung from the door or other mounting structure. This rigid frame component extends across the entire length of the organizer in order to keep the organizer from becoming deformed while hanging.

One disadvantage of the known prior art designs or hanging organizers is that the rigid frame component limits the ability to fold and store the hanging organizer when not in use. It also limits the ability to efficiently and economically package and ship the hanging organizer due to the fact that the packaging footprint is restricted by the length of the rigid frame component. Accordingly, a need exists for a hanging organizer with a rigid frame component that provides strong support to the organizer when being hung from a door or other object while still allowing for the organizer to be efficiently folded for storage and packaging.

The present invention meets this need.

DESCRIPTION OF THE SEVERAL VIEWS OF THE DRAWING

In the accompanying drawings, which form a part of the specification and is to be read in conjunction therewith in which like reference numerals are used to indicate like or similar parts in the various views.

DETAILED DESCRIPTION OF THE INVENTION

Figure 1:
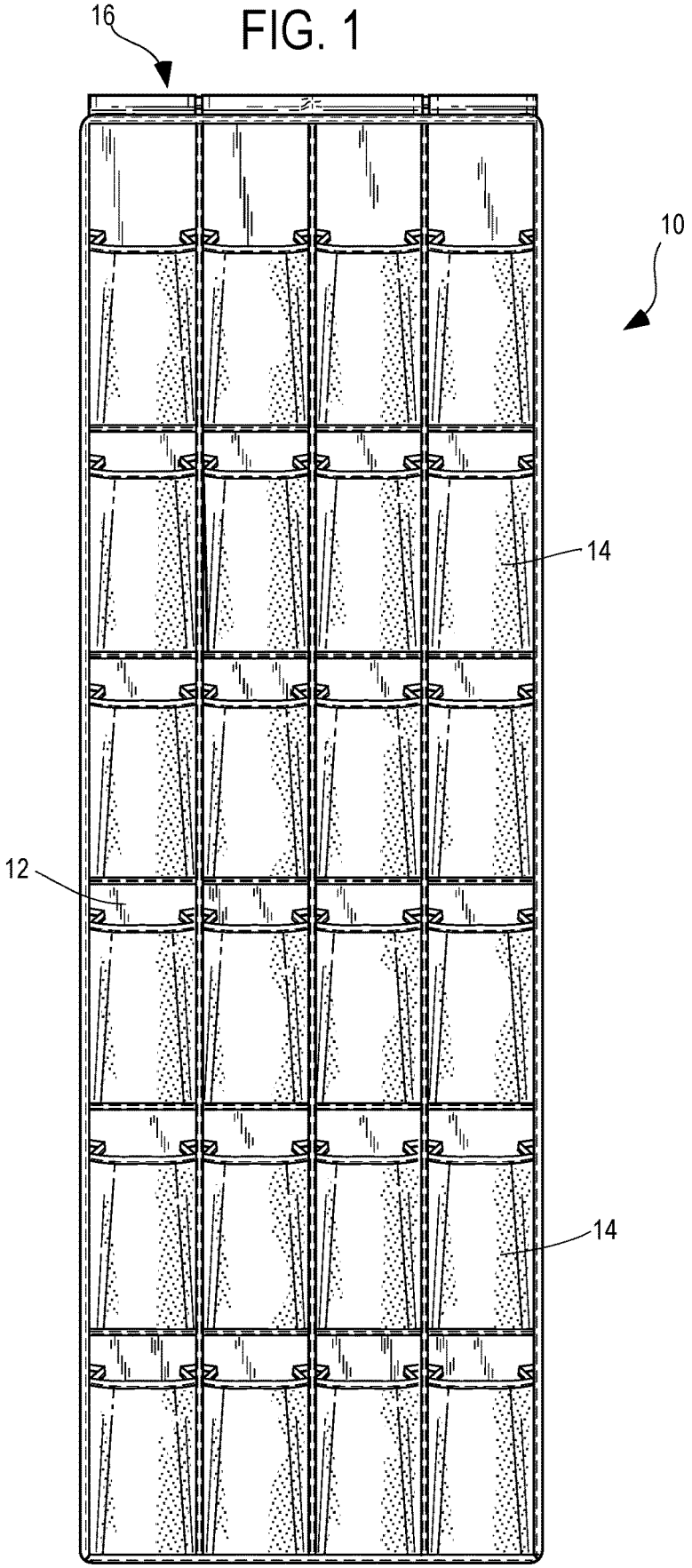
FIG. 1 is a front elevation view of a hanging organizer in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Referring to several figures, the present invention is directed generally to a hanging organizer 10 for storing various objects, including but not limited to shoes, clothing, hats or other garments, tools, equipment, household items or similar items. According to one embodiment, hanging organizer 10 can be configured as an over-the-door storage organizer that hangs from a door; however organizer 10 can also be configured to hang from a closet rod, be mounted on a wall or otherwise hung from any suitable object.

As shown in FIG. 1, hanging organizer 10 can include a base layer with a front surface 12, defining the size and shape of the organizer 10. The size and shape can vary greatly. Generally speaking, embodiments of the present invention are useful in hanging on a door. Accordingly, the shape is typically planar and rectangular. Of course, one of ordinary skill in the art would understand that many sizes and shapes can be designed to hang on a door. In other embodiments, the present invention can hang on a closet rod, for example. Any suitable size and shape can be designed for this use as well.

The base layer can be constructed of a fabric or fabric-type material. Examples include any type of material that is flexible and can be folded into a smaller size when being stored and not in use. Examples include canvas, vinyl such as PVC (polyvinyl chloride), plastic, other types of polyester, cotton, nylon, etc.

Figure 4:
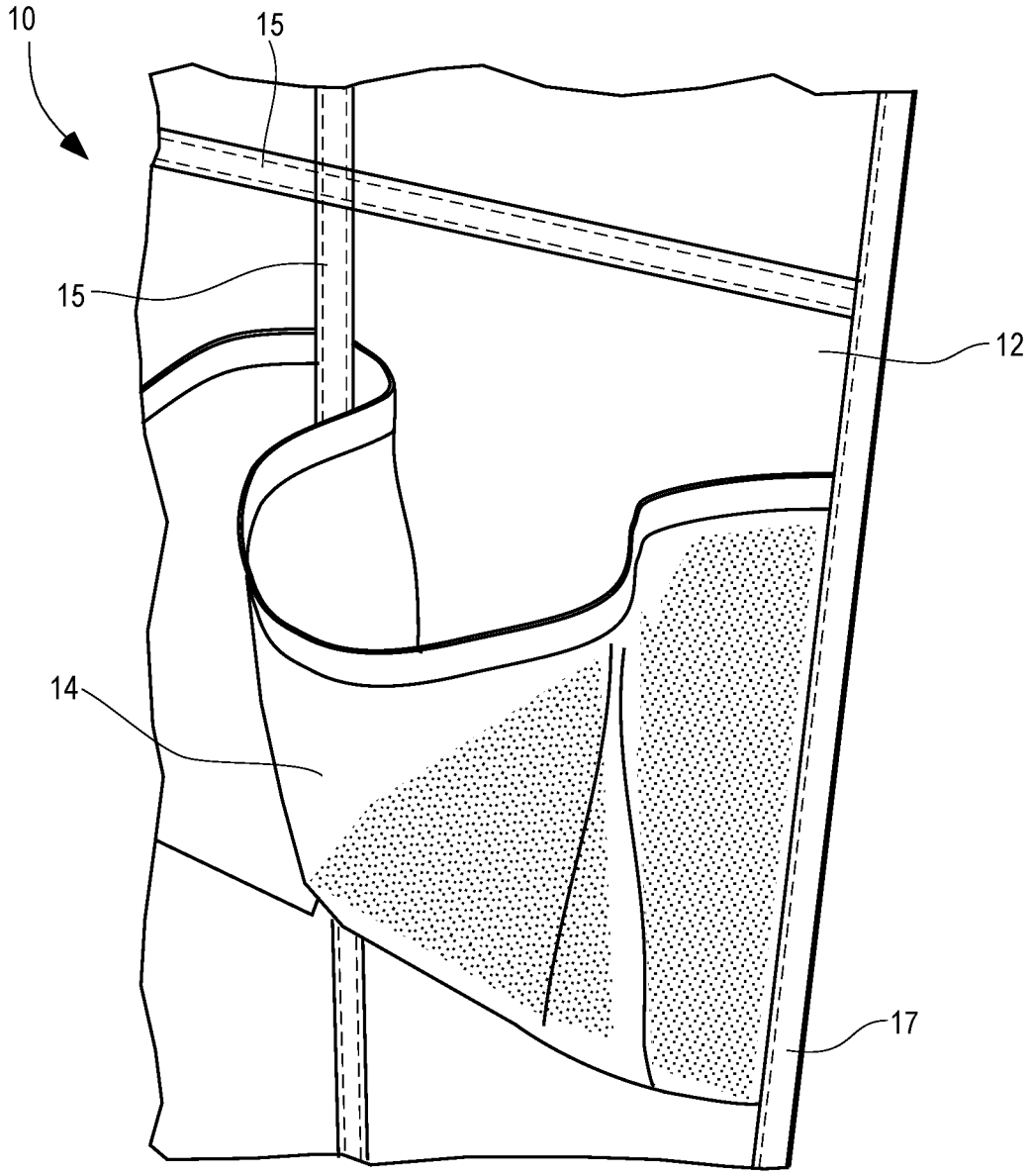
FIG. 4 is a partial perspective view of the hanging organizer of FIG. 1 illustrating a storage compartment of the hanging organizer in accordance with one embodiment of the present invention.

As further shown in FIG. 1, organizer 10 can additionally include one or more compartments or pouches 14 provided on or in the base layer front surface 12. Compartments 14 can be configured with any desired shape and form and can be secured to base layer 12 in any suitable manner. FIG. 4 illustrates the shape and configuration of compartment 14 according to one embodiment of the present invention; however, it is recognized that several other shapes and configuration of compartments 14 can be used in alternative embodiments. The compartments of FIG. 4 are generally pocket-shaped, with an opening in the top of the pocket. Compartments 14 can be configured to hold or store various types of objects by a user depending on the particular embodiment of organizer 10. Examples include household items, articles of clothing, shoes, lines, etc.

The compartments 14 can be designed to be the same or different material than the base layer. The compartment material may alternatively be a mesh or netted material to allow for a person to easily locate an item and to also provide ventilation of the articles.

The compartments 14 may also have sub-compartments. These sub-compartments may include separate vertical or slanted access slots, closable pockets along a compartment wall or along the base layer at the back of the compartment. The compartments may include an adjustable top elastic band to either close or reduce the size of the opening of the compartment.

The compartment may be three-sided, with the base layer front surface serving as the back portion of the compartment.

The compartments 14 may also be made of an expandable or stretchable material so that they can accommodate larger items. They may be of the open pocket design as shown in FIG. 1, or they may be enclosable. One or more zippers, hook and loop fasteners, or any other releasable fasteners can be incorporated into a compartment opening to allow access into the compartment interior and to facilitate inserting and removing articles from the compartments.

All compartments do not need to be same shape or design. In some embodiments, the compartments may be removable so that a user can design the compartments to suit their particular needs. Thus, some compartments may be large enough to hold larger linens, and other smaller to hold less bulky household items.

The compartments 14 may be attachable to the base layer front surface 12 in a variety of ways. As mentioned above, they may be removably attached to the base layer front surface or they may be permanently attached to the base layer front surface. For example, the base layer front surface may include hook and loop sections that can receive different compartments that are then attached onto the base layer front surface.

In the embodiment depicted in FIGS. 1 and 4, for example, the compartments are more permanently affixed to the base layer. In FIGS. 1 and 4, the compartments 14 are attached to the base layer front surface 12 by stitching. Also, optional twill tape 15 can be used to reinforce the stitching. A border twill tape 17 can be used to reinforce the outer perimeter of the organizer. In the embodiment of FIG. 4, the twill tape 15 is used in a checkerboard-type design to hold the compartments against the base layer front surface. Examples of the twill tape can be cotton, linen, polyester, or wool. The twill tape 15 and 17 may be the same or different material than the material that comprises the base layer and/or the compartments.

Figure 2:
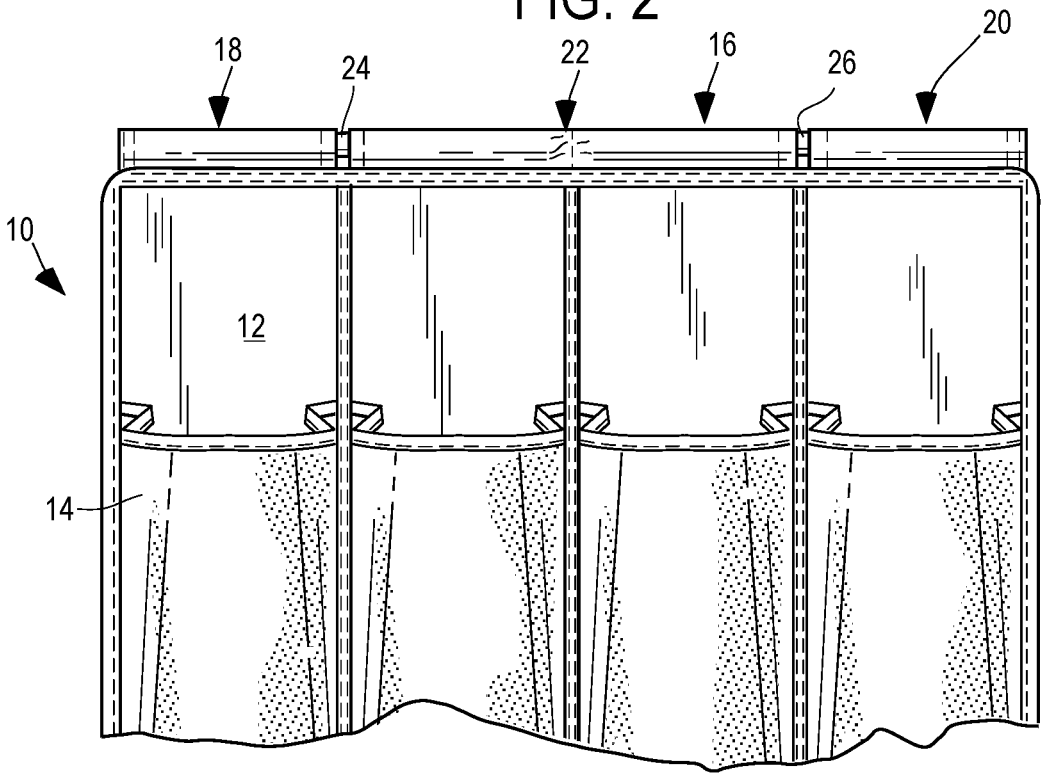
FIG. 2 is a partial elevation view of the hanging organizer of FIG. 1 illustrating the front of the hanging organizer in accordance with one embodiment of the present invention.
Figure 3:
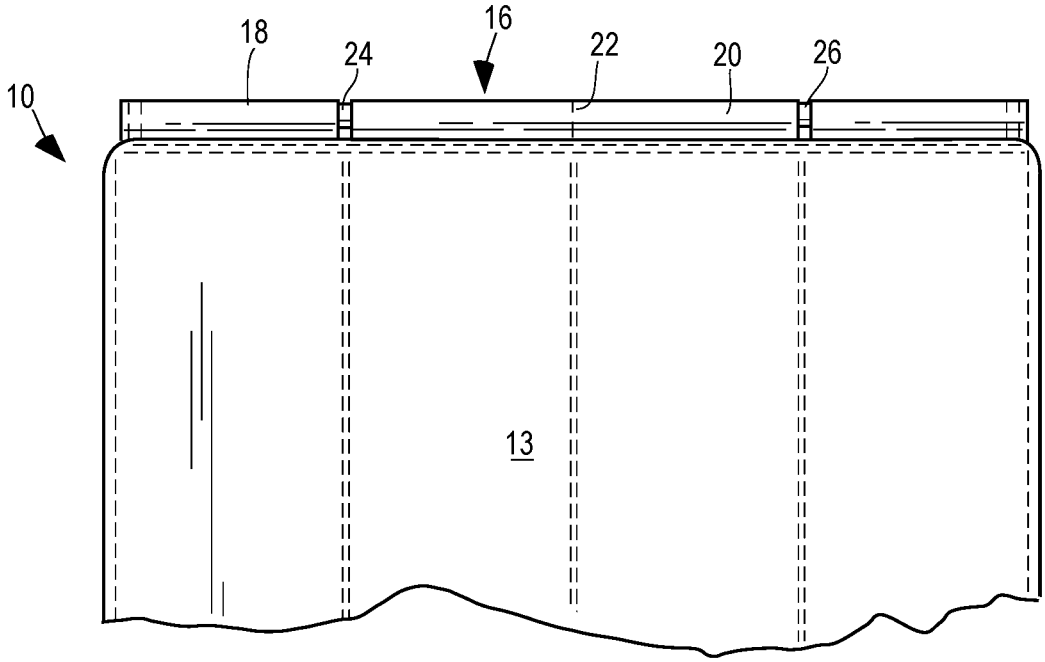
FIG. 3 is a partial elevation view of the hanging organizer of FIG. 1 illustrating the back of the hanging organizer in accordance with one embodiment of the present invention.

As best shown in FIGS. 2 and 3, organizer 10 can include a support component 16 configured to provide structural support to organizer 10 when organizer 10 is being hung from a door or other object. Support component 16 can also allow organizer 10 to maintain its desired shape when in the hanging position. As shown in FIGS. 2 and 3, according to one embodiment support component 16 can include a first rod pocket 18 and a second rod pocket 20 provided near the top portion of base layer 12. As shown, first and second rod pockets 18 and 20 can extend along the length of base layer 12. According to one embodiment, as shown in FIGS. 2 and 3, pockets 18 and 20 can be separated by a seam 22 provided between the two pockets 18 and 20.

As further shown in FIGS. 2 and 3 (and FIG. 7), support component 16 can further include a first support rod 24 and a second support rod 26. First and second support rods 24 and 26 can be configured to be inserted and retained within first and second pockets 18 and 20, respectively. As shown, first rod 24 can have a length approximately equal to first pocket 18 and second rod 26 can have a length approximately equal to second pocket 20. Once inserted into first and second pockets 18 and 20, first and second support rods 24 and 26 can provide structural support to organizer 10 and allow organizer 10 to maintain its shape when in use. In various other embodiments of the present invention, support component 16 may comprise additional pocket/rod pairs separated by a seam 22. For example, while the present figures illustrate support component 16 and organizer 10 with two pocket/rod pairs, support component 16 may comprise three, four or more pocket/rod pairs extending across the length of organizer 10.

The support rods can be made from practically any rigid material, as long as they are strong enough to support the organizer. For example, the support rod may be wood, plastic, ceramic, glass, metal, etc. Additionally, it may be round, oval, square, etc.

Figure 7:
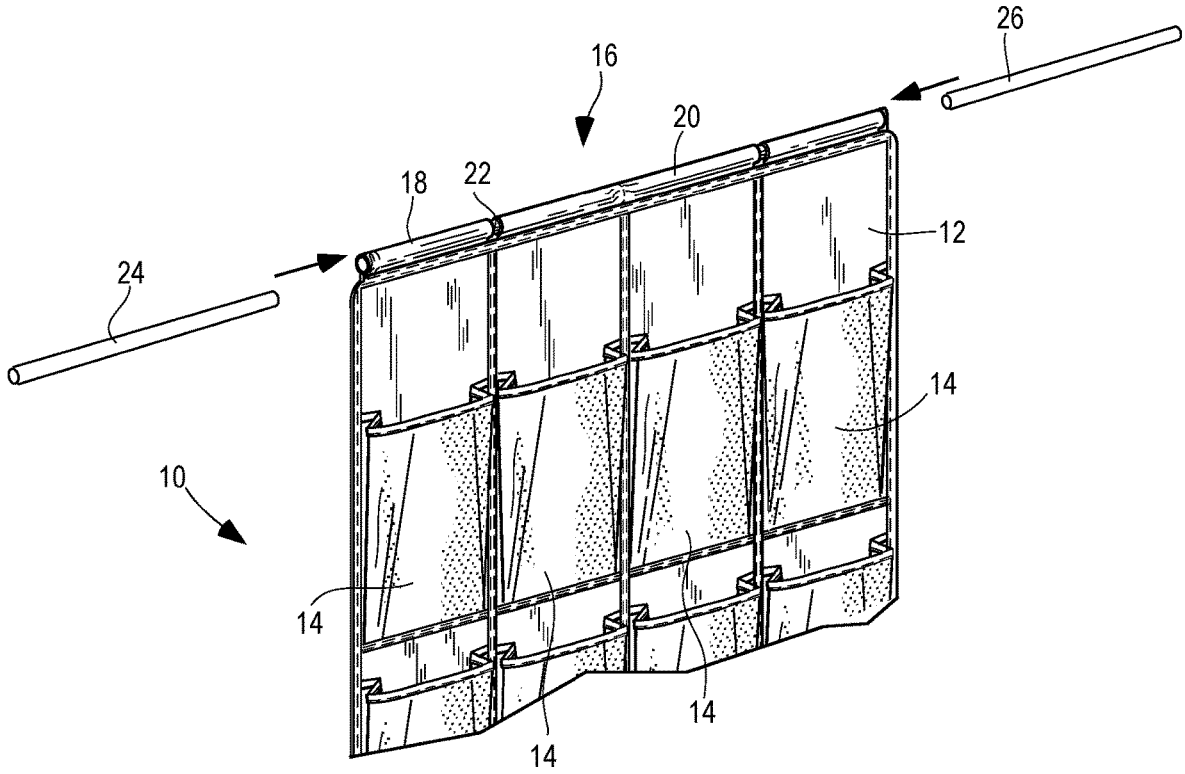
FIG. 7 is an exploded schematic view of a hanging organizer in accordance with one embodiment of the present invention.

Support component 16 can be configured to allow organizer 10 to maintain its expanded shape when being hung from a door or other object, yet be folded into a compact configuration for storage. As shown in FIGS. 2, 3 and 7, the multiple sets of pockets and rods 18 and 24 and 20 and 26, respectively, provide a configuration where support component 16 does not extend continuously across the entire length of organizer 10. Rather, one or more breaks or interruptions (seams 22) are positioned between the individual pocket and rod combinations comprising support component 16. This can enable organizer 10 to be folded at the seams 22 to place organizer 10 in a folded/compact configuration to reduce the overall footprint of organizer 10 when not in use. Such a configuration can be beneficial for storing, packaging and shipping one or more organizers 10.

Figure 5:
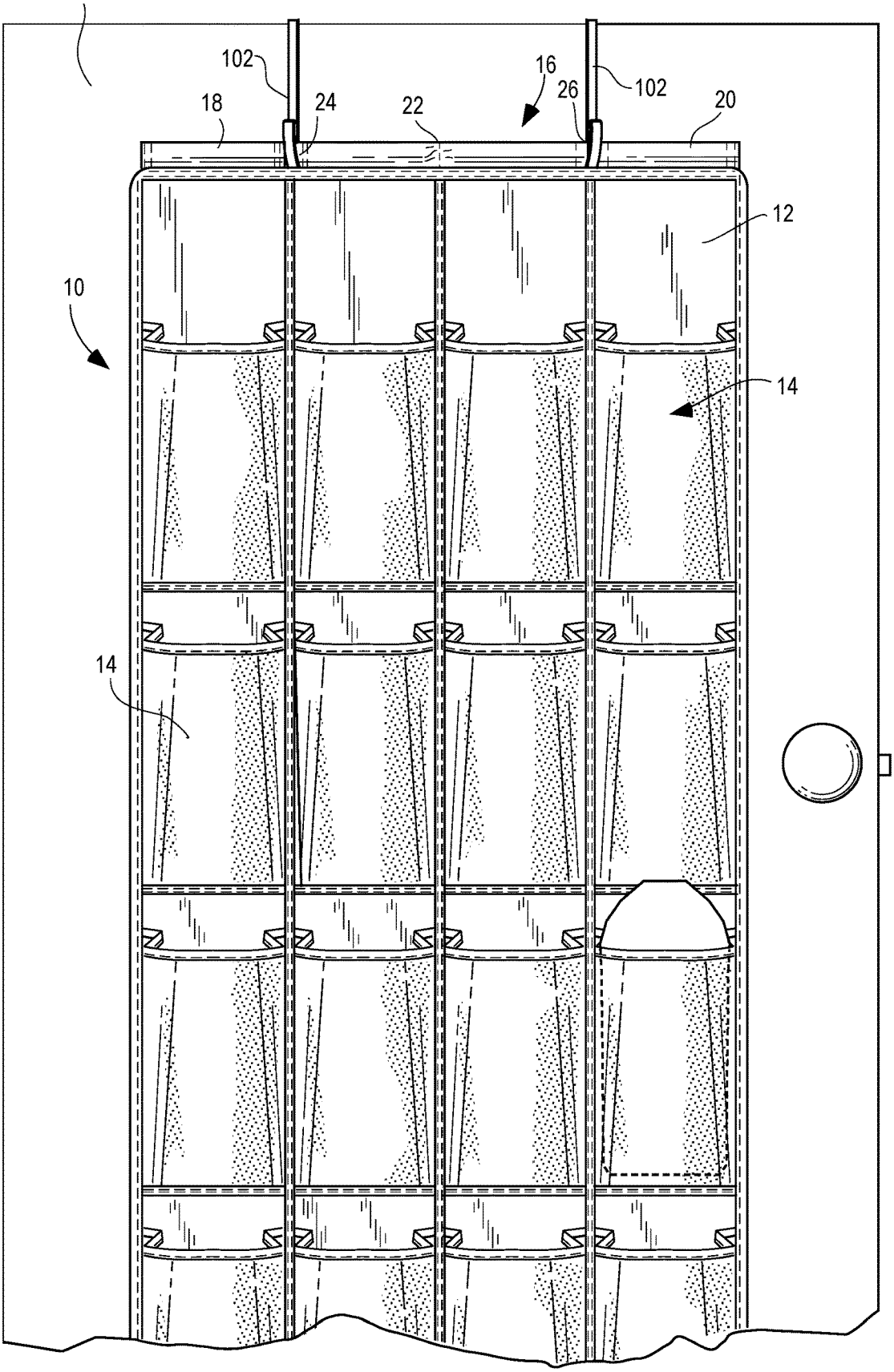
FIG. 5 is a front elevation view of a hanging organizer hanging over a door in accordance with one embodiment of the present invention.
Figure 6:
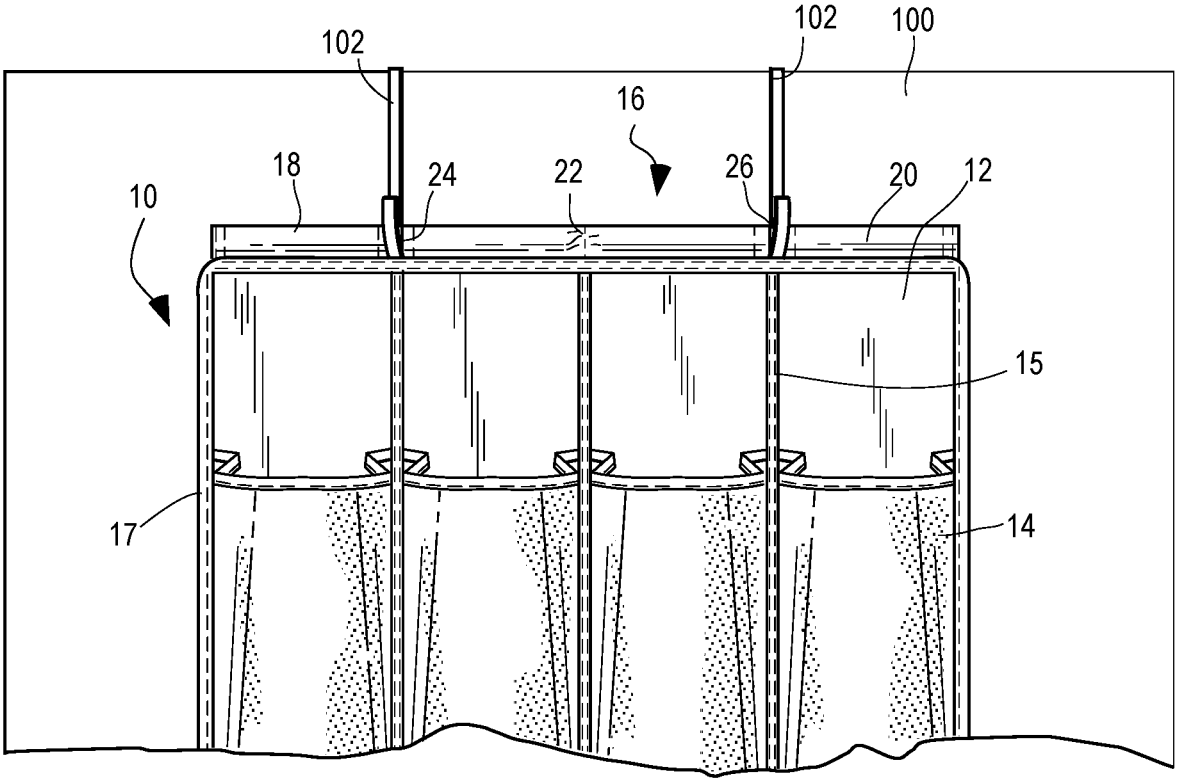
FIG. 6 is an enlarged partial elevation view of the hanging organizer of FIG. 5.

FIGS. 5 and 6 illustrate organizer 10 being hung from a door 100 by one or more hooks 102. As shown, support component 16 provides structural support for organizer 10 and allows organizer 10 to maintain its shape when in use. In these FIGS., the compartments 14 are formed by stitched twill tape 15, 17. In FIG. 5, an item 50 is shown that is being stored in a compartment 14.

The hooks 102 can be made of a variety of materials, including wood, plastic, or metal.

In the embodiments shown, the hooks bend over the top of the door 100. In the embodiment shown, the organizer includes two hooks. In the embodiment shown, there is one hook per rod pocket. The hook 102 engages the first or second support rod 24, 26, in a window 23 between the edge of the rod pocket 18 and the seam 22.

FIG. 5 also shows an article 50 that is stored in a compartment. In this embodiment, the compartments are formed by the intersecting pattern of the stitched twill tape 15 holding the compartment to the base layer front surface. The compartment has a top border 19 that may be the same or different material from the compartment body. Additionally, the compartment top border may be elastic.

FIG. 7 is exploded schematic view of a hanging organizer in accordance with one embodiment of the present invention. This FIG. shows a more detailed view of the support component 16 of the organizer of the present invention. As shown in the drawing, the first support rod 24 is inserted into the first pocket 18. The first pocket includes a window 23. The second support rod 26 is inserted into the second pocket. The second pocket also includes a window 23. The two pockets in the support component are divided by a seam 22. One method for hanging the organizer is to employ hooks 102 that can be inserted into the windows 23 to support the first and second support rods 24, 26.

Figure 8:
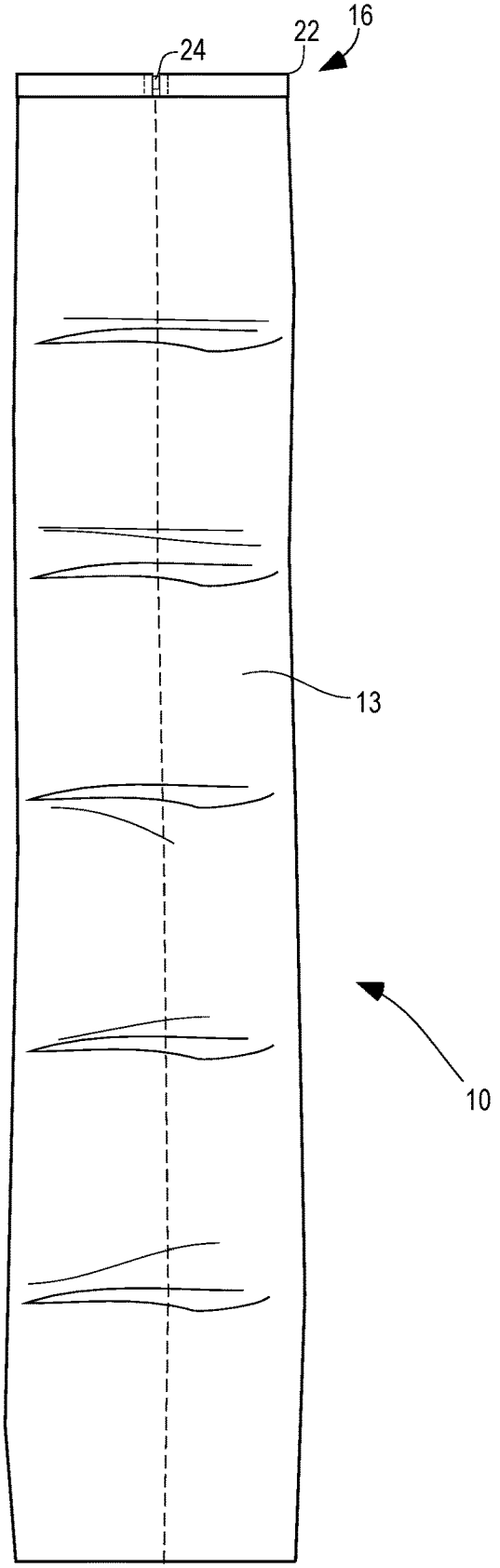
FIG. 8 is a perspective view of a hanging organizer configured into a folded configuration in accordance with one embodiment of the present invention.
Figure 8A:
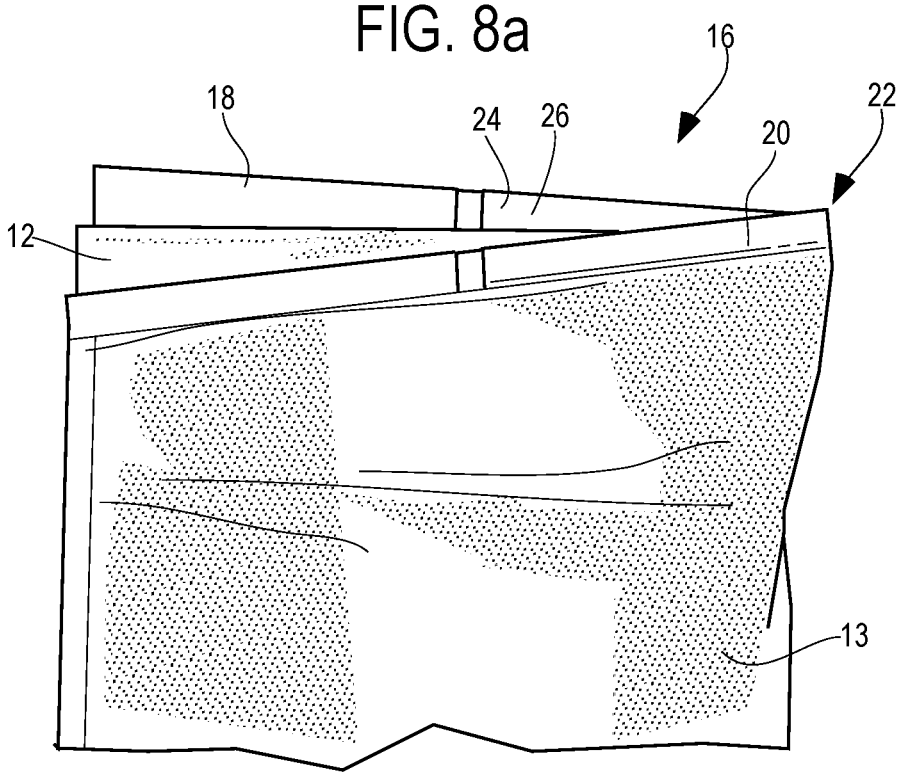
FIG. 8A is an enlarged partial perspective view of the hanging organizer configured into a folded configuration in accordance with one embodiment of the present invention.
Figure 9:
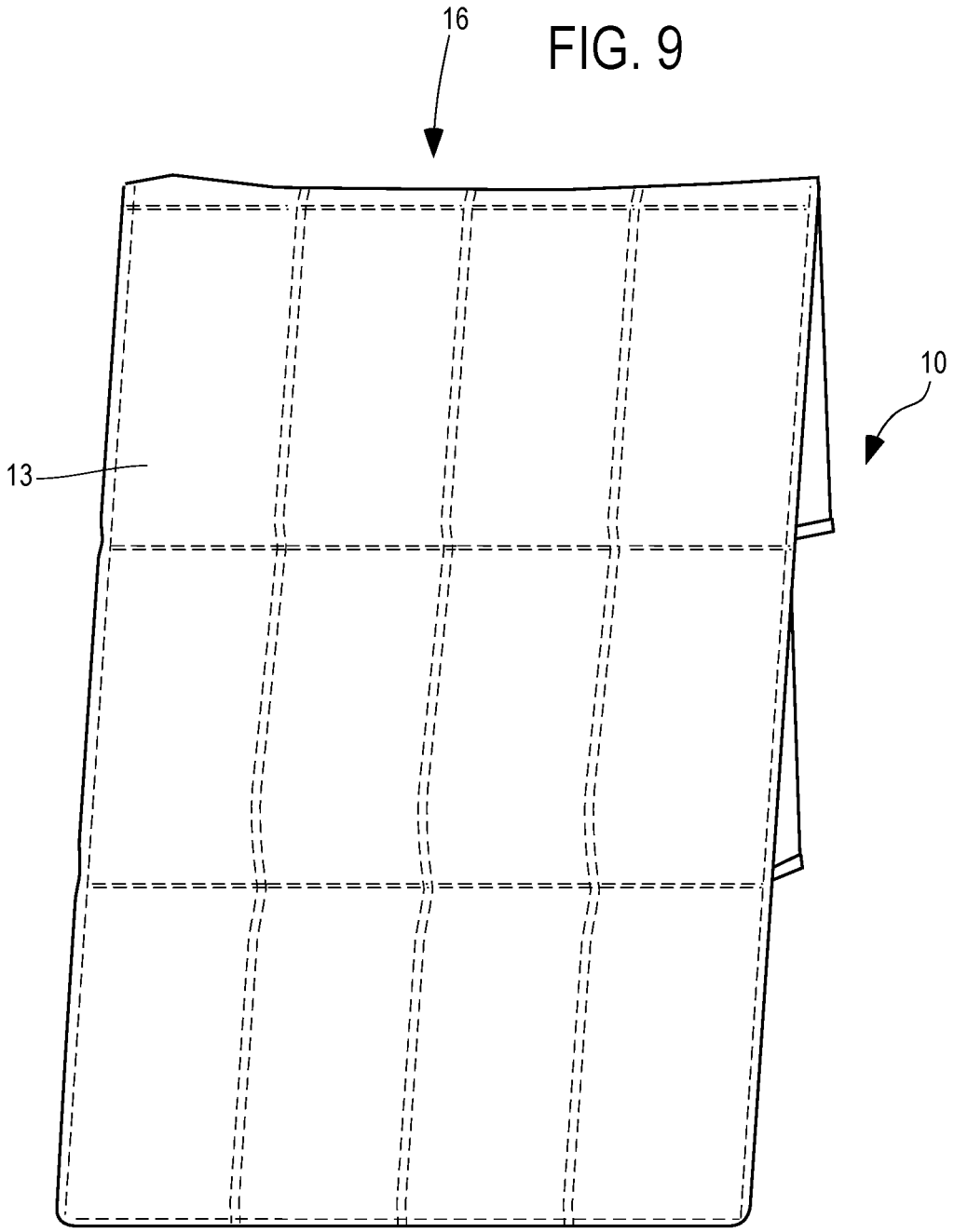
FIG. 9 is a perspective view of a hanging organizer configured into a folded configuration in accordance with one embodiment of the present invention.

FIGS. 8, 8A and 9 illustrate organizer 10 in folded configurations. As shown in FIGS. 8 and 8A, organizer 10 can be folded along the support component 16 seam 22, between the first pocket 18 and first rod 24 pair and the second pocket 20 and second rod 26 pair. Seam 22 and the separated rods 24 and 26 provide a brake that permits folding of organizer 10 in the lengthwise configuration. FIG. 9 illustrates organizer 10 in a folded configuration folded along the cross-wise or width-wise direction. In the figures, the base layer rear surface 13 is shown. Collectively, the folding of organizer 10 along with cross-wise direction and the lengthwise direction, which is permitted by the configuration of support component 16, allows organizer 10 to be compactly folded to a reduced footprint for more efficient storage, packaging and shipping.

Figure 10:
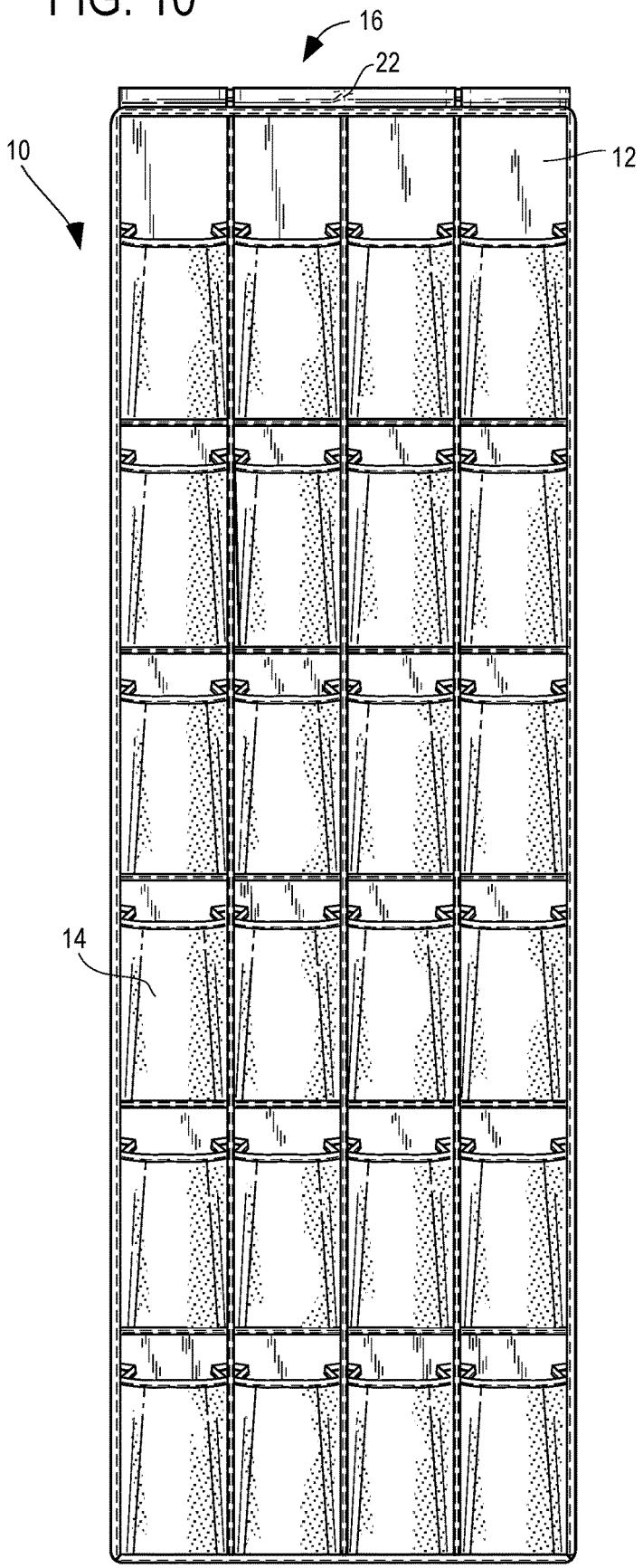
FIG. 10 is a elevation view of a hanging organizer in accordance with one embodiment of the present invention.
Figure 11:
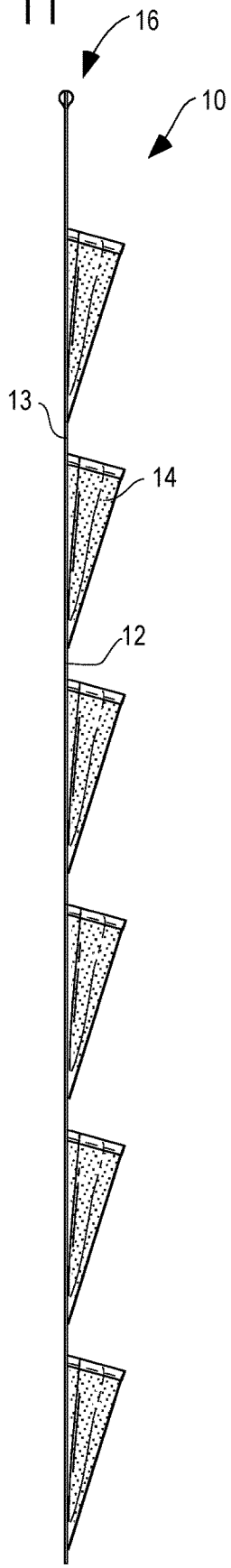
FIG. 11 is a front elevation view of the hanging organizer of FIG. 10.
Figure 12:
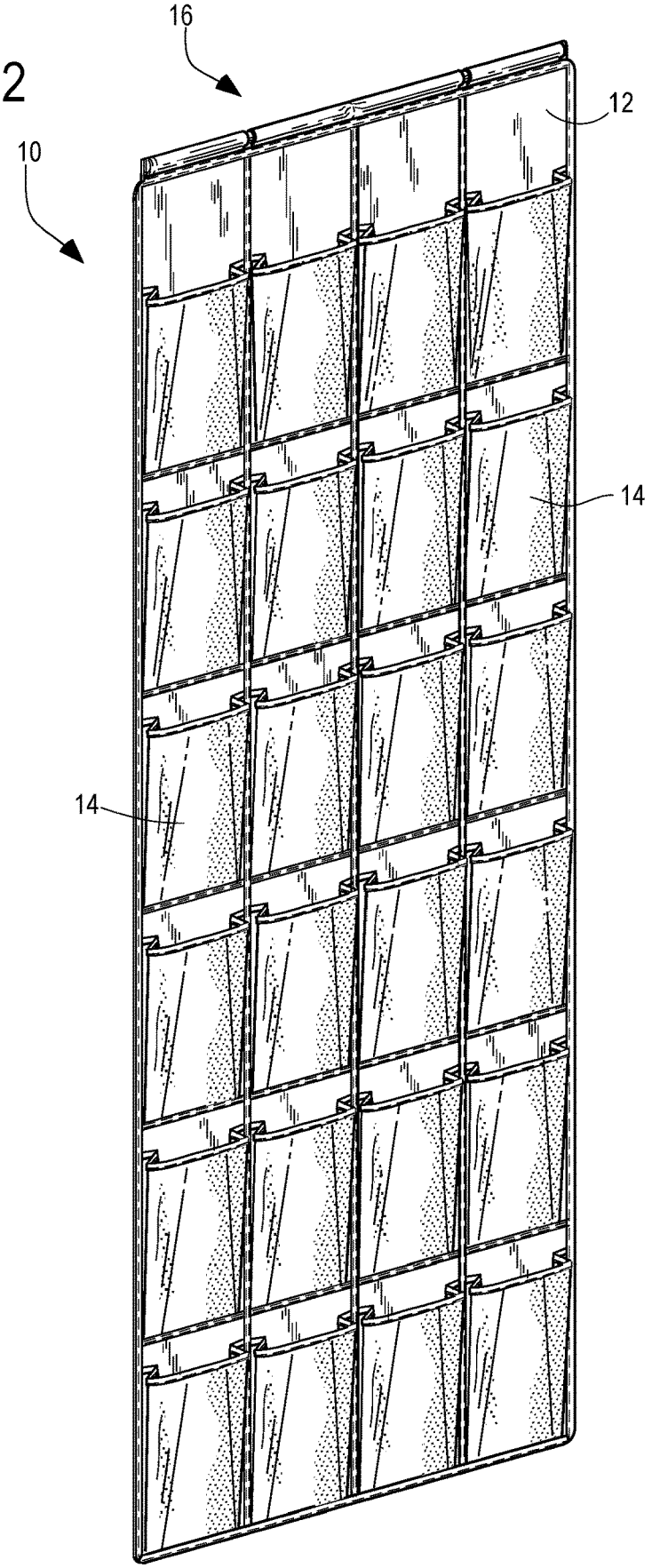
FIG. 12 is a side elevation view of the hanging organizer of FIG. 10.

FIGS. 10-12 show an embodiment of the present invention that includes uniform rows of compartments in the base layer front surface. The seam 22 of the support component 16 is generally in the middle of the organizer. This allows the organizer to be folded in half along its length. This would result in a fold similar to the one shown in FIG. 8.

Figure 13:
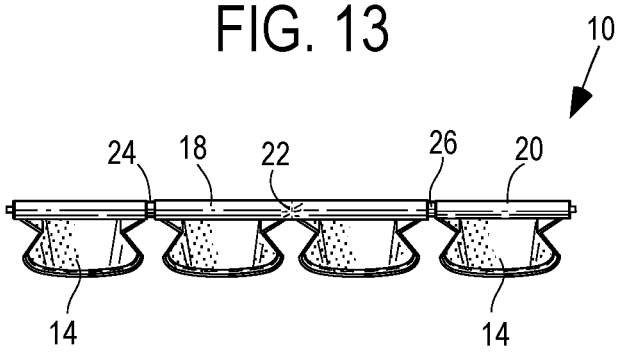
FIG. 13 is a top plan view of the hanging organizer of FIG. 10.
Figure 14:
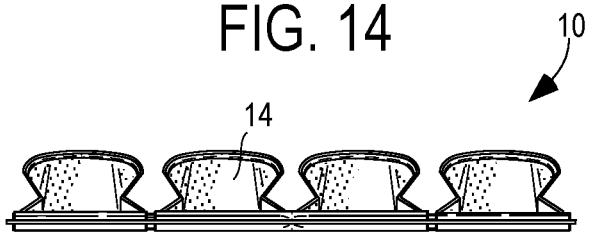
FIG. 14 is a bottom plan view of the hanging organizer of FIG. 10.

FIG. 10 thus shows the organizer 10 if the present invention that includes the support component 16 and the base layer. The compartments 14 are attached to the base layer by stitching and twill tape 15, 17. FIG. 11 is a side view of the embodiment shown in FIG. 10. FIG. 12 is a perspective view. FIGS. 11, 13, and 14 show the depth of examples of the compartments 14 of this embodiment. As stated above, the compartment size and configuration can be easily altered.

Figure 15:
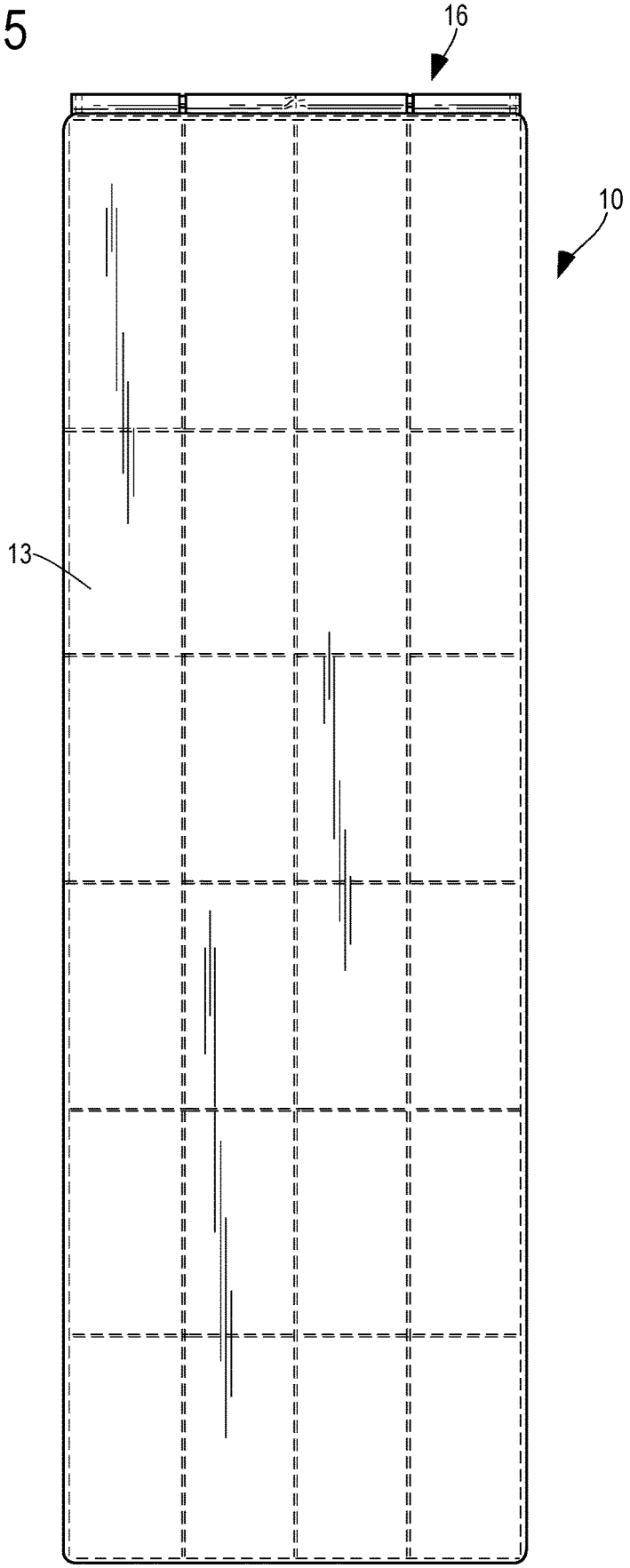
FIG. 15 is a rear elevation view of the hanging organizer of FIG. 10.

FIG. 15 shows the base layer rear surface 13, and stitching that supports the pockets that are on the opposite side of the base layer. The rear of the support component 16 is also shown.

It is also recognized that the support component 16 described above may be configured for use with any number of different hanging objects apart from organizer 10 in alternative embodiments of the present invention.

Figure 16:
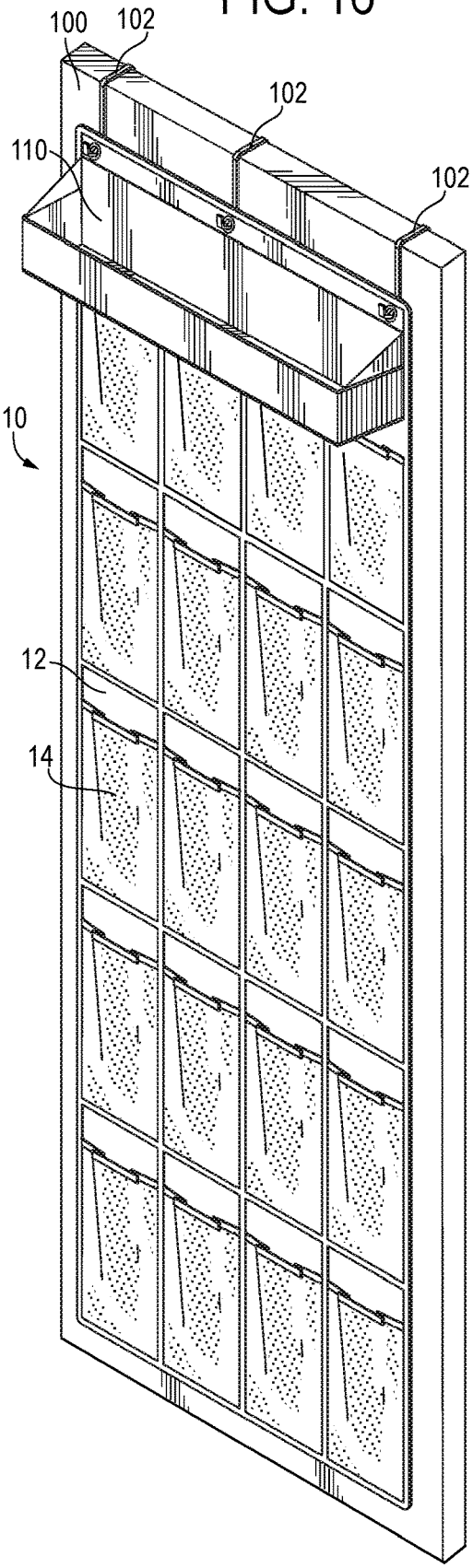
FIG. 16 is a perspective view of an embodiment of the present invention that incorporates a shelf feature in the design.

FIG. 16 shows an additional embodiment of the present invention, including an accessory that can be removably attached to the hanging organizer of the present invention. Specifically, FIG. 16 shows the hanging organizer 10 hanging on a door 100. The hooks are used to hang the organizer 10 on the back of the door 100. As described above, the hooks can be inserted into the windows 23 of the organizer. The accessory depicted in this figure is a shelf 110. The accessory shelf 110 will typically include a backing and a floor, as well as apertures to engage the hooks 102. In the embodiment shown in this Figure, the accessory shelf 110 comprises a backing and a floor, as well as a wall along the sides of the floor to help hold items on the shelf. In the embodiment shown, the shelf simply hangs on the hooks 102. In the embodiment shown in FIG. 16, the shelf has three apertures and three corresponding hooks support the organizer.

In embodiments of the invention, the shelf apertures allow the shelf to be detachable from the organizer.

The shelf 110 can be the same or different material from the organizer, particularly the base layer. That is, the shelf 110 can be constructed of a fabric or fabric-type material. Examples include any type of material that is flexible. Examples include canvas, vinyl such as PVC, plastic, other types of polyester, cotton, nylon, etc. In other embodiments, the shelf accessory can be inflexible, or less flexible than the organizer backing material.

If there is a need to create firmness in the shelf floor, it can be created from a different material. Additionally, a removable floor, such as a plastic floor, can be placed in the shelf to give it necessary support.

Figure 17:
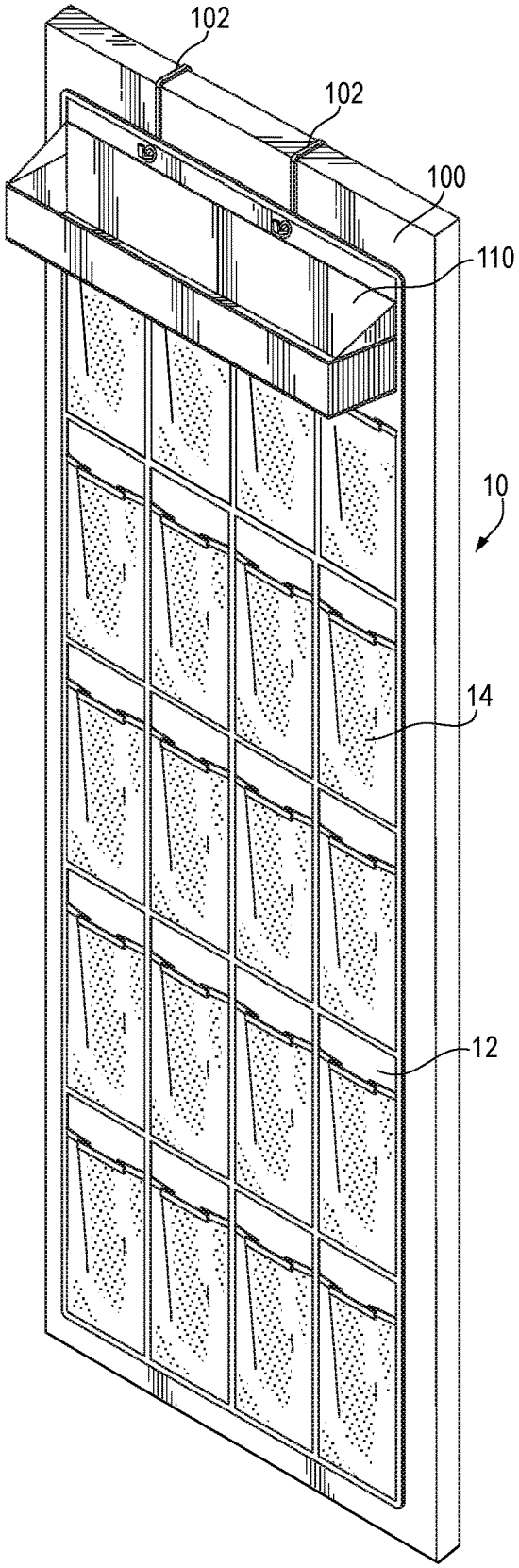
FIG. 17 is an additional perspective view of an embodiment of the present invention that incorporates a shelf feature in the design.

FIG. 17 shows an embodiment of the present invention where the shelf has two apertures and two hooks 102 are used to hang the organizer.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An organizer configured to hang on an object, comprising:

a planar and rectangular base layer having a front surface and a back surface, and defining a shape of said organizer;

at least one compartment provided on said base layer front surface; and a support component configured to provide structural support for said organizer, said support component comprising:

a first pocket, a second pocket;

the first pocket comprising a window;

a first support rod positioned within the first pocket and across the window;

the second pocket comprising a window;

a second support rod positioned within said second pocket and across the window;

a hook unit engaging the object and extending through the window and under the support rod, allowing the support rod to rest on the hook;

a shelf unit that comprises a backing, a floor that extends from the backing, and apertures in the backing, wherein the apertures engage the hook unit to allow the shelf unit to hang from the hook unit and rest against the base layer;

wherein the pockets are aligned in an end-to-end arrangement at the top of the base layer, permitting the organizer to be folded along a seam in a lengthwise direction.

2. The organizer of claim 1, wherein the shelf unit has at least two apertures that engage two hook units.

3. The organizer of claim 1, wherein the shelf unit includes a backing, floor, and a shelf wall that attaches to the backing and floor.

4. The organizer of claim 3, wherein the shelf wall is shorter that the shelf backing.

5. The organizer of claim 1, wherein the object is a door.

6. The organizer of claim 1, wherein object is a closet rod.

7. The organizer of claim 1, wherein the base layer is a fabric.

8. The organizer of claim 1, wherein the base layer is comprised of canvas, vinyl, plastic, polyester, cotton, nylon, or combinations thereof.

9. The organizer of claim 1, wherein the compartments are pockets.

10. The organizer of claim 1, wherein the compartments are fabric.

11. The organizer of claim 1, wherein the compartments are comprised of canvas, vinyl, plastic, polyester, cotton, nylon, or combinations thereof.

12. The organizer of claim 1, wherein the compartments are mesh.

13. The organizer of claim 1, wherein the compartments comprise a top border.

14. The organizer of claim 13, wherein the top border comprises an elastic material.

15. The organizer of claim 1, wherein the compartments are attached to the base layer front surface by an intersecting pattern of stitched twill tape along the borders of the compartments.

16. The organizer of claim 1, wherein the shelf unit is comprised of canvas, vinyl, plastic, polyester, cotton, nylon, or combinations thereof.

* * * * *